United States Patent [19]

Erickson

[11] 4,285,401

[45] Aug. 25, 1981

[54] ELECTRIC AND HYDRAULIC POWERED THERMAL STIMULATION AND RECOVERY SYSTEM AND METHOD FOR SUBTERRANEAN WELLS

[75] Inventor: John W. Erickson, Huntington Beach, Calif.

[73] Assignee: Kobe, Inc., Commerce, Calif.

[21] Appl. No.: 157,745

[22] Filed: Jun. 9, 1980

[51] Int. Cl.[3] ..... E21B 43/12; E21B 43/24

[52] U.S. Cl. ..... 166/303; 166/53; 166/60; 166/65 R; 166/314

[58] Field of Search ..... 166/53, 65 R, 64, 60, 166/61, 62, 302, 303, 314, 68, 105

[56] References Cited

U.S. PATENT DOCUMENTS

| | | | |
|---|---|---|---|
| 1,648,242 | 11/1927 | Powell | 166/60 |
| 2,954,826 | 10/1960 | Sievers | 166/60 |
| 3,342,267 | 9/1967 | Cotter et al. | 166/60 |
| 3,614,986 | 10/1971 | Gill | 166/60 X |
| 4,127,169 | 11/1978 | Tubin et al. | 166/303 X |

*Primary Examiner*—Stephen J. Novosad
*Attorney, Agent, or Firm*—William C. Norvell, Jr.

[57] ABSTRACT

A thermal recovery system for a subterranean well includes an electric heater located immediate the bottom of the well which cyclically receives electric power generated at the well surface. A pump directs a stream of pressurized fluid, such as water, through a conduit to a solenoid valve located at the bottom of the well. The solenoid valve senses electric power application relative to the heater and directs the stream of pressurized water to one of two fluid circuits. When electric power is supplied to the heater, the solenoid valve directs the fluid stream into the heater. The heater thermally stimulates the well and is cooled by the water which is heated and exhausted to thermally stimulate the well. When electric power is not supplied to the heater, the solenoid valve directs the pressurized water to a turbine for driving a production pump. In an alternate embodiment, both the heater and the production pump are operated continuously and the fluid stream is divided between the turbine and the heater.

25 Claims, 3 Drawing Figures

ELECTRIC AND HYDRAULIC POWERED THERMAL STIMULATION AND RECOVERY SYSTEM AND METHOD FOR SUBTERRANEAN WELLS

BACKGROUND OF THE INVENTION

1. Field of the Invention

The present invention relates to thermal stimulation and recovery systems for subterranean wells.

2. Description of the Prior Art

Presently, low pressure, non-flowing oil wells account for the vast majority of the oil wells in the United States. There are various pump means available for pumping these non-flowing subterranean wells, the most common of these pump means being the sucker rod subsurface pump. Other types of pumps include electrical and hydraulic pumps. In a geothermal well, water can be pumped to a steam turbine in the bottom of the well where the water is turned into steam to drive the turbine.

Such non-flowing subterranean wells benefit from thermal stimulation. Energy can be transmitted to the bottom of the well in the form of steam or in the form of electricity to operate heating elements. The steam system has several disadvantages, some of which are air pollution caused by the fuel burning process in the steam boiler and the heating of the casing as the steam is transmitted through a conduit down the well. A major disadvantage of the electrical heating system is the difficulty in maintaining a selected heater temperature setting as the temperature of the surrounding area varies. A rapid increase in the temperature of the surrounding area would often cause the heater elements to overheat and burn up in the bottom of the well.

SUMMARY OF THE INVENTION

The present invention relates to a method and an apparatus for thermally stimulating and recovering oil from a subterranean well. Electric power is supplied to an electric heater located at the bottom of the well. The application of electric power to the heater is controlled by a cyclic control switch located at the well surface. Water is pressurized at the surface of the well and is directed down a conduit where it is an input to a solenoid valve. The solenoid valve senses the application of electric power to the heater and, if electric power is being supplied to the heater, directs the pressurized water into the heater to cool it. The heater then heats the water and exhausts the hot, pressurized water into the well to cut away the rock formation and thermally stimulate the well. If electric power is not being supplied to the heater, the solenoid valve directs the pressurized water to a turbine for driving a production pump. The pump pumps production fluid consisting of heat oil and water through a conduit to the well surface. In an alternate embodiment, both the heater and the pump are operated continuously and the water is divided between the heater and the turbine.

DESCRIPTION OF THE PREFERRED EMBODIMENTS

Figure 1:
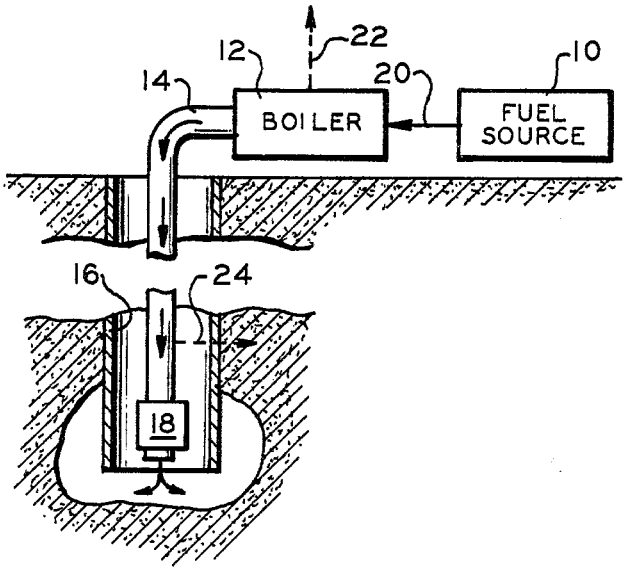
FIG. 1 (PRIOR ART)
FIG. 1 is a schematic view of a prior art thermal stimulation and recovery system for a subterranean well.

FIG. 1 is a schematic view of a prior art steam flood type thermal stimulation system for a subterranean well. A fuel source 10 supplies fuel to a boiler 12 to heat water into steam. A pipe 14 is connected between an outlet of the boiler and the bottom of a well 16. The steam can be exhausted into the well 16 to thermally stimulate the well. The steam can also be utilized to drive a steam turbine and pump 18 to pump oil from the well.

For the purposes of only an illustrative example, and not by way of limitation, a representative fuel supply 10 supplies one hundred units of energy to the boiler 12 through a conductor 20. A typical boiler is approximately sixty-five percent efficient, losing thirty-five units of energy into the environment at 22 and sending steam having sixty-five units of energy down the pipe 14 into the well 16. Losses into the well and the surrounding ground at 24 are approximately fifty units. Thus, approximately fifteen units of energy reach the bottom of the well and are available for heating.

Figure 2:
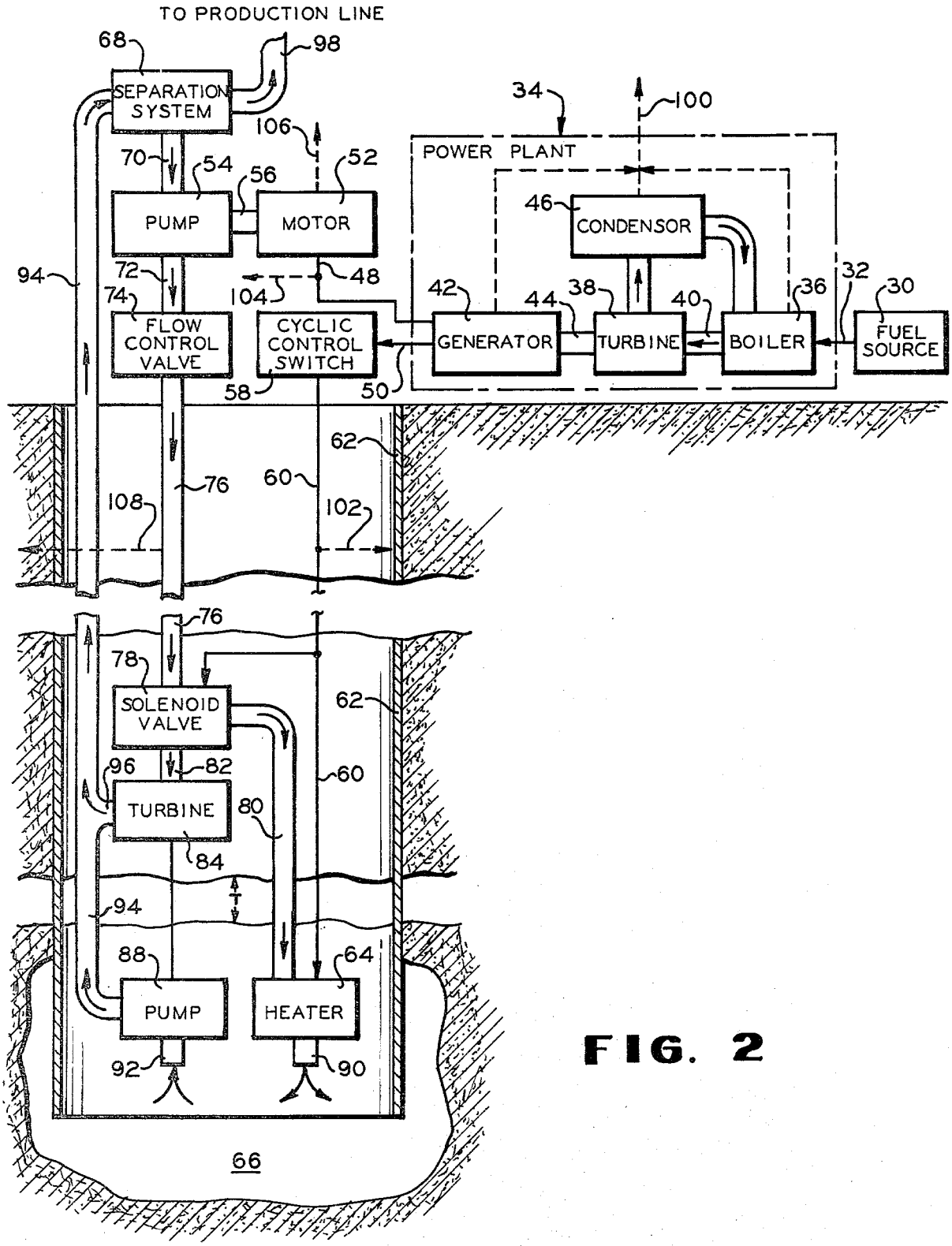
FIG. 2 is a schematic view of a thermal stimulation and recovery system according to the present invention.

There is shown in FIG. 2, in schematic form, an electric and hydraulic powered thermal recovery system. A fuel source 30 supplies fuel through a conduit 32 to a power plant 34 such as an electric power generating system.

The power plant 34 includes a boiler 36 which utilizes the fuel to heat water into steam. The steam is supplied to a turbine 38 through a conduit 40. The steam drives the turbine which is coupled to a generator 42 by a shaft 44. The steam supplied to the turbine is then condensed by a condensor 46 and returned to the boiler 36.

The generator 42 converts the rotating mechanical energy of the shaft 44 into electric power which is generated over electric lines 48 and 50. The line 48 is connected to an electric motor 52 which converts the electric power to mechanical energy which is transmitted to a pump 54 by a shaft 56. The line 50 is connected to a cyclic control switch 58 which controls the application of electric power to an electric line 60. The line 60 is run down a well casing 62 where it is connected to an electric heater 64 located at the bottom of the well 66.

The pump 54 receives fluid such as water, for example, from a fluid source such as a separation system 68 through a conduit 70. The pump 54 converts the mechanical energy from the motor 52 into hydraulic energy by pressurizing the fluid and directing the pressurized fluid through a conduit 72 to a flow control valve 74. The outlet of the valve 74 is connected to a conduit 76 which is run down the well casing 62 where it is connected to a solenoid valve 78. The flow control valve 74 maintains a predetermined rate of flow of pressurized fluid down the well, regardless of any well pressures attempting to resist the flow.

The solenoid valve 74 senses the application of electric power to the line 60 and directs the fluid received from the conduit 76 to one of two outlets, depending on whether or not the switch 58 is supplying electric power to the line 60. If electric power is present on the line 60, the solenoid valve 74 directs the pressurized fluid down a conduit 80 and into the heater 64. If no electric power is present on the line 60, the valve 78 directs the pressurized fluid down a conduit 82 to drive a turbine 84.

The turbine 84 is coupled by a shaft 86 to drive a production pump 88. The shaft 86 extends through a thermal barrier having a thickness T in the range of, for example, five to ten feet. The thermal barrier is interposed between the heated region around the pump 88 and the region of major fluid flow at the turbine 84. Although shown separate, the electric line 60 could be run down the well inside the conduits 76 and 80.

As previously mentioned, the heater 64 receives the pressurized fluid from the pump 54 through the valves 74 and 78 when electric power is generated on the line 60. The heater 64 includes heating elements (not shown) for converting the electric power on the line 60 into heat energy.

The flow control valve 74 maintains a constant fluid flow through the heater to militate against overheating of the heating elements. The elements are positioned to transfer heat energy to the pressurized fluid as the fluid flows through the heater and is exhausted through a heater outlet 90 into the well 66. The hot, pressurized fluid tends to cut away the well formation, while thermally stimulating the well 66.

After the well formation has been thermally stimulated, the control switch 58 cuts off power to the valve 78 and the heater 64. This causes the valve 78 to direct the pressurized fluid down the conduit 82 to the turbine 84, while stopping fluid flow to the heater 64. The turbine 84 drives the pump 88 which collects production fluid consisting of heated oil and water at an inlet 92. The pump 88 pumps the mixture to the surface through a conduit 94 where the conduit 94 is connected to the separation system 68. The water which was utilized to drive the turbine 84 is exhausted into a conduit 96 which could be connected to the conduit 94, as shown in FIG. 2, or run to the surface as a separate line. Since the fluid in the conduit 96 is basically water and the fluid in the conduit 94 is a mixture of water and oil, connecting the conduits would require a larger separation system whereas separate lines would require twice as much conduit.

The separation system 68 is typically a gravity-type tank which is utilized to separate the water from the oil in the production fluid. The oil is directed to a production line 98 for subsequent refining, while the water is directed into the conduit 70 to be used as the fluid source for the pump 54.

If the fuel source 30 supplies one hundred units of energy to the power plant 34, the power plant loses approximately sixty-five units in the conversion process to the environment at 100. Thus, thirty-five units of electrical energy will be generated. Of this thirty-five units, ten units are generated on the line 48, while twenty-five units are generated on the line 50 to the control switch 58.

Resistive losses in the lines 50 and 60 result in a loss of five units of energy at 102, such that twenty units of energy are supplied to heater 64. Similarly, resistive losses in the line 48 result in a loss of two units of energy at 104 such that eight units of electrical energy are supplied to the motor 52.

The electric motor is relatively efficient and loses only about one unit of energy at 106 in converting the electrical energy into approximately five units of hydraulic energy and two units of heat energy in the form of pressurized fluid. The energy loss in the flow control valve 74, the conduits 76 and 80, and the solenoid valve 78 is typically about two units of heat energy and one unit of hydraulic energy. This energy is lost to the well and the surrounding ground at 108. Thus, approximately four units of hydraulic energy are supplied to the heater 64 by the conduit 80 in addition to the twenty units of electrical energy from the line 60.

Typically, the heater 64 is relatively efficient such that the twenty-four units of combined hydraulic and electrical energy are converted into twenty-four units of hydraulic and heat energy including hot, pressurized fluid. Thus, approximately twenty-four units of energy are available to thermally stimulate the well, compared with the fifteen units of energy available in the prior art system of FIG. 1.

Figure 3:
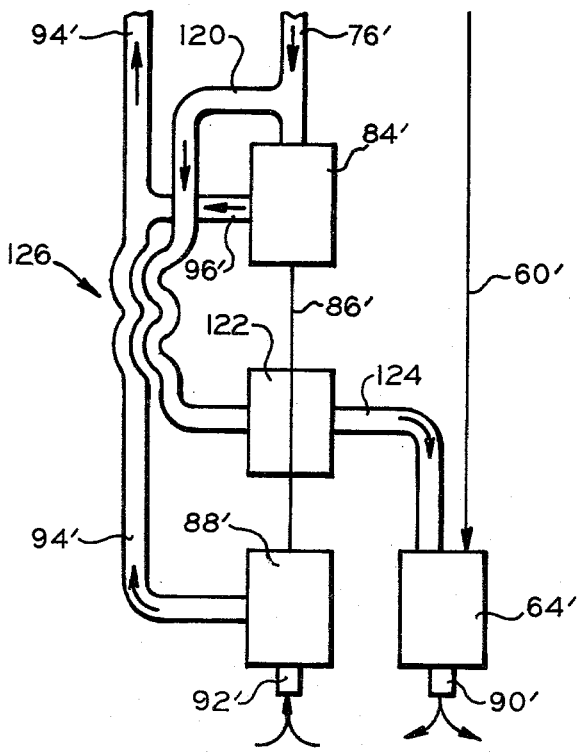
FIG. 3 is a fragmentary schematic view of an alternate embodiment of the thermal stimulation and recovery system shown in FIG. 2.

There is shown in FIG. 3 a schematic view of an alternate embodiment of the present invention in which the thermal recovery system can be run continuously. The electric line 60', the heater 64', the conduit 76', the turbine 84', the production pump 88', the heater outlet 90', the pump inlet 92', the conduit 94', and the conduit 96' are similar to like numbered elements in FIG. 2. However, the solenoid valve 78 has been eliminated and a conduit 120 is connected between the conduit 76' and the inlet to a pump 122. A portion of the pressurized fluid from the surface bypasses the turbine through the conduit 120 and is pressurized to a relatively high value by the pump 122. The outlet of the pump 122 is connected to the inlet of the heater 64' by a conduit 124. The pump 122 is driven from the shaft 86' which is coupled to the production pump 88'.

The conduit 120 is connected through one side of a heat exchanger 126. The conduit 94' is connected through the other side of the heat exchanger 126. The heat in the production fluid is transferred to the fluid in the conduit 120 which is bypassing the turbine 84' and entering the pump 122. Moreover, the heat energy produced through the heat exchanger 126 may be recovered and re-cycled to the well production formation to the produced fluid. Such an alternate system can be run continuously. Furthermore, if the pressure of the fluid in the conduit is sufficiently high, the pump 122 can be eliminated and the conduit 120 connected to the inlet of the heater 64'.

Means, such as the heat exchanger 126, a heat absorbing conduit shield, or the like, may also be provided to cool the fluid transmitted through conduit 94' or 94 to reduce thermal expansion problems in the conduit 94' or 94 to the top of the well.

In addition to being more efficient than the prior art system, the present system has other advantages which should be considered. The temperature of the water being piped down the well is less than the temperature of the steam in the prior art system. Therefore, the drill string or other conduit is not overheated and heat related problems are eliminated or substantially reduced. The system according to the present invention also eliminates the emissions from the prior art boiler located at the well and shifts them to the power plant which is equipped to handle such a problem.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A system for thermally stimulating and recovering produced fluid from a subterranean well, comprising: a source of pressurized fluid; an electric power source for generating electric energy; a heater means positioned in the well for thermal stimulation and having a fluid inlet connected to said fluid source, a fluid outlet to the well, and a heating element in said heater connected to said electric power source for converting said electric energy into heat energy; and a fluid driven pump means connected to said fluid source for pumping produced fluid from the well, said pressurized fluid flowing through said heater means and receiving heat energy from said heating element to cool said heater means and to thermally stimulate the well.

2. The system according to claim 1 wherein said electric power source cyclically applies said electric energy and including means connected to said power source for connecting said heater means fluid inlet to said fluid source when said electric energy is applied and for connecting said pump means to said fluid source when said electric energy is not applied whereby cycles of thermal stimulation by said heater means are alternated with cycles of produced fluid recovery by said pump means.

3. The system according to claim 2 wherein said means connected to said electric power source includes a valve having a fluid inlet connected to said fluid source, a first fluid outlet connected to said heater means fluid inlet, a second fluid outlet connected to said pump means, and means responsive to said electric energy for connecting said valve fluid inlet to said first fluid outlet when said electric energy is generated and for connecting said valve fluid inlet to said second fluid outlet when said electric energy is not generated.

4. The system according to claim 1 including flow control means connected between said fluid source and said heater means fluid inlet for supplying fluid at a predetermined flow rate to said heater means.

5. The system according to claim 1 wherein said pump means includes a fluid driven turbine connected to said fluid source for driving an output shaft and a production pump driven by said output shaft to pump the produced fluid from the well.

6. The system according to claim 5 including a pump connected between said fluid source and said heater means fluid inlet and driven by said output shaft for increasing the pressure of the fluid flowing through said heater means to thermally stimulate the well.

7. The system according to claim 1 including a heat exchanger having one side connected between said fluid source and said heater means fluid inlet and another side connected between said pump means and the top of the well.

8. The system according to claim 7 including means for recovering heat energy produced through said heat exchanger and means for re-cycling said recovered heat energy through said produced fluid.

9. The system according to claim 1 further comprising a conduit extending from said pump means for transmission of produced fluid to the top of the well, and means for cooling the produced fluid within said conduit.

10. A system for thermally stimulating and recovering produced fluid from a subterranean well, comprising: a source of pressurized fluid; an electric power source for cyclically generating electric energy; heater means positioned in the well for thermal stimulation and having a fluid inlet, a fluid outlet to the well, and a heating element connected to said electric power source for converting said electric energy into heat energy; fluid driven pump means for pumping the produced fluid from the well; and means responsive to said electric energy for connecting said fluid inlet to said fluid source when said electric energy is generated and for connecting said pump means to said fluid source when said electric energy is not generated whereby cycles of thermal stimulation by said heater means are alternated with cycles of produced fluid recovery by said pump means.

11. The system according to claim 10 including flow control means connected between said fluid source and said heater means fluid inlet for supplying fluid at a predetermined flow rate to said heater means.

12. The system according to claim 11 wherein at least a portion of said heat energy is transferred from said heating element to said fluid to cool said heater means and to thermally stimulate the well with heated fluid from said fluid outlet.

13. The system according to claim 10 wherein said pump means includes a turbine having an inlet connected to said fluid source through said electric energy responsive means and an output shaft, and a production pump connected to said output shaft whereby fluid from said fluid source drives said turbine which drives said production pump to pump the produced fluid from the well.

14. The system according to claim 10 wherein said means responsive to electric energy includes an electrically operated solenoid valve having a fluid inlet connected to said fluid source, a first fluid outlet connected to said heater means fluid inlet, a second fluid outlet connected to said pump means, and means connected to said electric power source for connecting said valve fluid inlet to said first fluid outlet when said electric energy is applied and for connecting said valve fluid inlet to said second fluid outlet when said electric energy is not applied.

15. A method for thermally stimulating and recovering produced fluid from a subterranean well comprising:

(a) supplying electric energy to the bottom of the well;
(b) directing a stream of pressurized fluid to said bottom of the well;
(c) converting said electric energy into heat energy to thermally stimulate the well;
(d) transferring a portion of said heat energy to said fluid stream and utilizing said fluid stream to thermally stimulate the well; and
(e) utilizing hydraulic energy in said fluid stream to pump the produced fluid from the well.

16. The method according to claim 15 wherein step (b) is performed by directing said fluid stream at a predetermined flow rate.

17. The method according to claim 15 wherein step (c) is performed by applying said electric energy to an electrical resistance heating means.

18. The method according to claim 17 wherein step (d) is performed by utilizing said fluid stream to cool said heating means.

19. The method according to claim 15 wherein step (a) is performed by cyclically applying said electric energy, steps (c) and (d) are performed when said electric energy is applied, and step (e) is performed when said electric energy is not applied.

20. The method according to claim 15 further comprising the step of: (f) recovering a portion of said heat energy and recycling said recovered heat energy through step (d).

21. The method according to claim 15 further comprising the steps of: (f) transmitting the produced fluid to the top of the well in a production conduit; and (g) cooling the produced fluid in said conduit to reduce thermal expansion effects on said conduit.

22. A method for thermally stimulating and recovering produced fluid from a subterranean well, comprising:

(a) cyclically supplying electric energy to a bottom of the well;

(b) directing a stream of pressurized fluid to said bottom of the well;

(c) converting said electric energy into heat energy in said fluid stream to thermally stimulate the well; and (d) alternating with said cycles of electric energy, converting hydraulic energy in said pressurized fluid stream into mechanical energy for pumping the produced fluid from the well.

23. The method according to claim 22 wherein step (b) is performed by directing said fluid stream at a predetermined flow rate.

24. The method according to claim 22 wherein step (c) is performed by converting said electrical energy into said heat energy in an electrical resistance heating means and utilizing said fluid stream to cool said heating means by transferring a portion of said heat energy to said fluid stream.

25. The method according to claim 22 wherein step (d) is performed by sensing the absence of said electric energy and driving a turbine connected to a pump means with said fluid stream to pump the produced fluid from the well.

* * * * *